US007802639B2

(12) United States Patent
Paul et al.

(10) Patent No.: US 7,802,639 B2
(45) Date of Patent: Sep. 28, 2010

(54) DRIVE DEVICE FOR A BORING BAR

(75) Inventors: Wolfgang Paul, Bad Schwartau (DE); Dirk Heidemann, Schwerte (DE); Maciej Barcikowski, Bochum (DE)

(73) Assignee: Ruhrpumpen GmbH, Witten (DE)

( * ) Notice: Subject to any disclaimer, the term of this patent is extended or adjusted under 35 U.S.C. 154(b) by 869 days.

(21) Appl. No.: 10/484,549

(22) PCT Filed: Jul. 23, 2002

(86) PCT No.: PCT/EP02/08192

§ 371 (c)(1),
(2), (4) Date: Jul. 15, 2004

(87) PCT Pub. No.: WO03/009948

PCT Pub. Date: Feb. 6, 2003

(65) Prior Publication Data

US 2004/0253066 A1 Dec. 16, 2004

(30) Foreign Application Priority Data

Jul. 23, 2001 (DE) ..... 101 34 952

(51) Int. Cl.
*E21B 19/16* (2006.01)
*E21B 21/01* (2006.01)

(52) U.S. Cl. ..... 175/207; 166/90.1; 166/379

(58) Field of Classification Search ..... 166/77.1, 166/78.1, 90.1, 311, 312, 379, 77.51, 104, 166/66.4; 175/65, 207.84, 170, 195
See application file for complete search history.

(56) References Cited

U.S. PATENT DOCUMENTS

| | | | | | |
|---|---|---|---|---|---|
| 1,377,575 | A | * | 5/1921 | Greve | 173/199 |
| 1,395,706 | A | * | 11/1921 | Greve | 173/79 |
| 1,526,976 | A | * | 2/1925 | Sylvester | 173/75 |
| 2,006,128 | A | * | 6/1935 | Casperson | 74/417 |
| 2,848,196 | A | * | 8/1958 | Simmonds | 175/52 |
| 2,998,084 | A | * | 8/1961 | Johnson et al. | 175/85 |
| 3,054,465 | A | * | 9/1962 | Fish | 279/4.01 |
| 3,208,539 | A | * | 9/1965 | Henderson | 175/215 |
| 3,763,941 | A | * | 10/1973 | Leibee et al. | 173/197 |
| 4,437,524 | A | * | 3/1984 | Boyadjieff et al. | 173/190 |
| 4,574,893 | A | * | 3/1986 | Young et al. | 175/170 |
| 5,113,936 | A | * | 5/1992 | Sutherland | 166/85.1 |
| 5,251,709 | A | * | 10/1993 | Richardson | 175/220 |

FOREIGN PATENT DOCUMENTS

GB 1603608 A * 11/1981

* cited by examiner

*Primary Examiner*—Kenneth Thompson
(74) *Attorney, Agent, or Firm*—Bachman & LaPointe, P.C.

(57) ABSTRACT

A drive apparatus for a drill stem, in particular for de-coking systems, has a feeder (4) connected to a water supply (8) via a first interface (6) and connected to a drill stem (12) via a second interface (10), as well as a drive (14) and a gearbox (16) for rotatably driving said feeder (4) and said drill stem (6), characterized in that said feeder (4) has a first section (20) connected to the water supply (8) and a second section (40) connected to the drill stem (12) and the first (20) and second (40) sections are releasably connected to each other.

8 Claims, 2 Drawing Sheets

DRIVE DEVICE FOR A BORING BAR

BACKGROUND OF THE INVENTION

The present invention relates to a drive apparatus for a drill stem, in particular for de-coking systems.

In oil refineries, the last otherwise unusable fraction of the crude oil is transformed into coke. This transformation is performed by feeding this fraction into drums which are filled with coke as the operation proceeds. Once the maximum filling level of the drums has been reached, the coke is cut out from the drums.

This so-called "de-coking" is usually carried out using high-pressure water jets which disintegrate the coke and wash it out of the drums. The tool for generating these high-pressure water jets is inserted into the drums from the top using a drilling rig. The subject of the present invention is in particular the construction of the drill stem drive and therefore the transition from the water supply to the drill stem.

In prior art generic systems, this transition from the water supply to the drill stem is formed as an integral feeder. The first, top end is connected to a water supply via a flange. The second, bottom end of the feeder is connected to the flange of the drill stem. This second, bottom end is usually supported in thrust and journal bearings in order to ensure smooth rotation. At the second end of the feeder there is also a gear box which causes the drill stem to rotate in operation. The water supply, the feeder and the drill stem are connected in an aligned and liquid-tight fashion so that a tool attached to the free end of the drill stem for de-coking is supplied with the requisite water in an operating state.

In the area of the feeder, the sealing rings, which are positioned at the transition between stationary and rotating structural elements, are particularly subject to wear and tear and must be replaced at regular intervals. Wear and tear shows at the first end of the feeder, where a fluid-tight connection is to be established to the water supply and at the same time fixed and rotating parts of the drive apparatus are adjacent to each other. In prior art systems, the sealing rings acting as sealing elements at the transition between fixed and rotating structural parts must be replaced in the steel frame of the de-coking system while the drill stem drive is in place, which contributes to maintenance overhead.

SUMMARY OF THE INVENTION

It is therefore an object of the present invention to simplify the structure of such a drive apparatus for a drill stem and to make the replacement of the sealing elements more maintenance friendly and more economical.

This object is achieved by a drive apparatus according to claim 1. A drive apparatus with a feeder comprising first and second sections, enables faster and error-free replacement. A second section, which extends from the drill stem and is virtually wear-free, remains in a state securely bolted to the gearbox and the drill stem. Malfunctions resulting from repeated interference with these structural elements are thus reliably ruled out.

The first section of the feeder may be released by simple means and is otherwise connected to the second section in a safe and liquid-tight manner. The connection, in particular the sealing elements between the first section of the feeder and the water supply, which is subject to wear and tear, does not have to be replaced in order to use the drilling apparatus of the present invention. The type of connection between the water supply and the feeder does not necessarily have to be changed. All that remains to be done is to replace a compact and complete assembly.

The advantage of replacing a compact, complete assembly is that the sealing elements no longer have to be replaced while the drill stem drive is in place and under spacially difficult conditions. The assembly, comprising the first section of the feeder of the drill stem drive with the worn out sealing rings, may now be cleaned and repaired at leisure and provided with new sealing rings. The repaired assembly is then ready to be reused in a drill stem drive. Since the attachment to the second section is via a relatively simple connection, the drill apparatus of the present invention can be repaired in much shorter time.

The drill apparatus is not weakened by partitioning the feeder as long as the type of connection between the two sections takes the loads into account that have to be absorbed. In particular it is preferred to design this releasable connection between the two sections as a clamp, bolt or flange. A clamp connection preferably provides a means for clamping, connecting the first and the second section of the feeder. In the same way, a bolting means according to a preferred embodiment provides a means for bolting which connect the first and second sections of the feeder. Such connections are known as such, and a person skilled in the art will be well acquainted with the corresponding approaches.

With drilling apparatus of the prior art, the gear box causing the feeder and the drill stem to rotate was usually individually manufactured because of the predominant opinion that this was a special application which required special measures when designing and adapting the gearbox. The gear boxes of the prior art are enclosed by a housing filled with oil.

It is to be seen as an autonomous inventive step that the drill apparatus of the present invention is structurally simplified by the consistent use of standardized structural parts that are available from a supplier catalogue. By using standardized parts, the operational safety of the apparatus is usually also increased, since these parts have already been tested in numerous other applications. Additionally, the cost of the drill apparatus is advantageously reduced.

It is therefore considered an inventive step to suggest a gear box for drilling apparatuses, in particular for use in de-coking systems, which is formed as an open, greased gear-rim drive. Surprisingly, such gear boxes, which are known for swivelling applications, have proven to be sufficiently robust for the use in drilling apparatuses. The maintenance and repair of such gear boxes is particularly simple and quick.

BRIEF DESCRIPTION OF THE DRAWINGS

One of the possible embodiments of the invention is described in more detail with reference to FIG. 1 and FIG. 2, in which.

DETAILED DESCRIPTION

Figure 1:
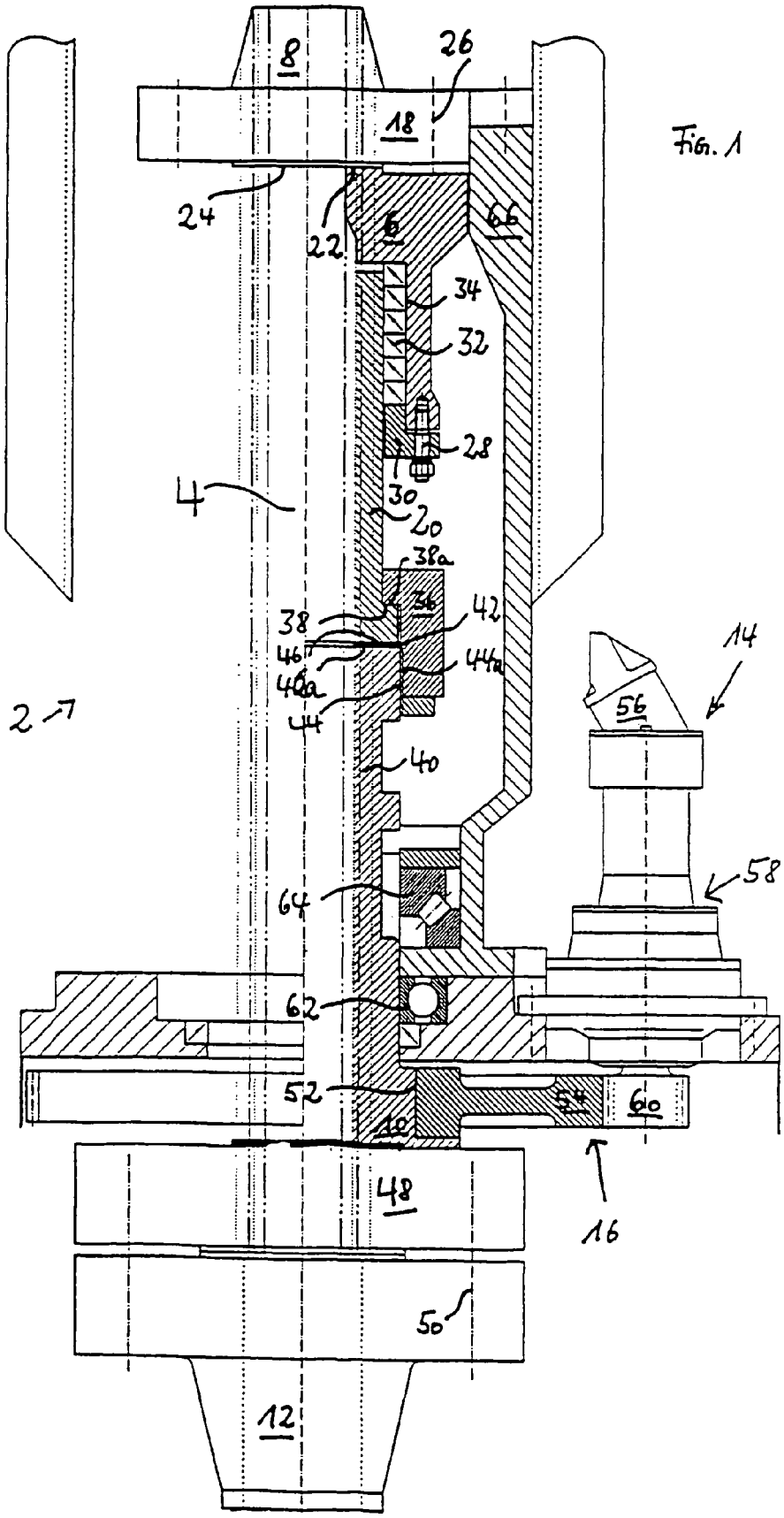
FIG. 1 is a longitudinal sectional view of a drive apparatus of a drill stem according to the present invention.

Apparatus 2 of the present invention for driving the drill stem comprises a feeder 4 with a first connection 6 to a water supply 8 and a second connection 10 to a drill stem 12, as well as a drive 14 for a gear box 16 causing feeder 4 and drill stem 12 to rotate in operation.

Water supply 8, only schematically shown in the figure, is usually formed as a gooseneck. It ends in a flange 18 at which a first section 20 of the feeder 4 abuts. The connection to the first section 20 is provided by a first interface 6. Interface 6 has a contacting surface 22 contacting flange 18. In order to make the connection liquid tight, a standardized seal 24 is provided between interface 6 and flange 18.

Interface 6 is releasably connected to flange 18 by bolts 26, only schematically shown in the figure. Interface 6 embraces sealing packings 32 surrounding the first section 20. To counteract the water pressure in feeder 4, packings 32 are releasably secured by bolts 28 at the bottom through a support 30. In order to ensure effective sealing between water supply 8, stationary interface 6 and the first section 20 of feeder 4, which rotates in operation, a plurality of sealing packings 32 completely fill an annular cavity 34 between interface 6 and first section 20.

Figure 2:
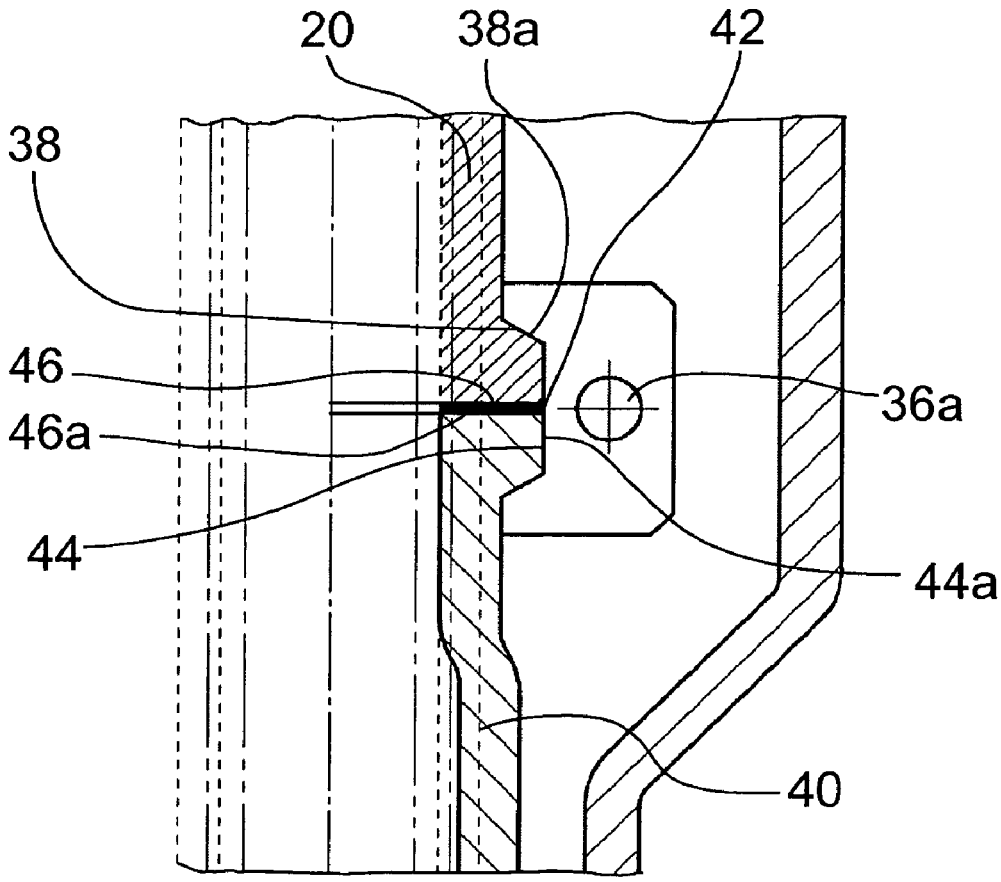
FIG. 2 is a fragmentary view taken in the plane of FIG. 1, showing an alternative connection of a first and a second section of a feeder.

The first section 20 is connected to the second section 40 via a clamp 36 engaging the first section via contacting surfaces 38, 38*a*. A sealing 42 is inserted between the two sections 20, 40. Clamp 36 contacts the second section 40 via contacting surfaces 44, 44*a*. Sections 20, 40 are formed to be planar on the surfaces 46, 46*a* facing each other, and on their outer circumferences they only have the above-described contacting surfaces 38, 38*a* and 44, 44*a*. The manufacture, assembly and disassembly of the first section 20 thus require little cost and time. As shown in FIG. 2 the clamp 36 can be substituted by bolts 36*a*.

Once the packings 32 are worn out, they have to be replaced. In order for the replacement to be simple, safe and quick, an assembly comprising first section 20, packings 32 and interface 6 is taken out of drive apparatus 2 after clamp 36 and interface 6 have been released. An identical assembly provided with new packings 32 is inserted in drive apparatus 2. Clamp 36 and interface 6 are then closed again in a sealing relationship. Drive apparatus 2 may be put back in operation after only a short standstill.

The second section 40 is formed to be integral with interface 10, to which gear 16 is attached. A further element of interface 10 is flange 48, to which drill stem 12 is bolted. Bolts 50 are only schematically shown. The circumferential surface 52 of interface 10, i.e. the end of second section 40 facing drill stem 12 is formed as an outer gear rim. A gear 54 is in mesh with this outer gear rim 52, wherein gear 54 is caused by drive 14 to rotate in operation.

Drive 14 comprises a motor 56. In the present case, this is an electric motor. However, hydraulic or pneumatic motors could also be used. A gearbox 58 is connected downstream of motor 56, wherein the output gear of gearbox 58 is in mesh with gear 54. Outside gear rim 52, gear 54 and output gear 60 form gearbox 16. Outside gear rim 52 and gears 54 and 60 are formed to be an open, greased gearbox 16. A closed gearbox housing is not necessary, and this is why the need for large quantities of gearbox oil is eliminated. The approach of using an open gearbox 16 of the present invention is particularly simple and easy to maintain. It has the additional advantage that outside gear rim 52 does not have to be specially manufactured for each new feeder 4, which must be regularly replaced when worn out.

The parts with reference numerals 54, 56, 58, and 60 are all standardized components as offered in suppliers' catalogues and tested in numerous other applications.

A thrust bearing 62 and a journal bearing 64 are also positioned in the area of interface 10, i.e. at the end facing the second section 40. These bearings 62 and 64 support the loads applied by gearbox 16 and drilling apparatus 2 as well as by the drilling apparatus's own weight and ensure smooth rotation of drilling apparatus 2 when in an operative state.

To cover feeder 4 rotating in an operating state, drill apparatus 2 has a lantern 66, representing the connection between water supply 8 and gearbox unit 16. The drill stem drive is mounted and held by lantern 66. Lantern 66 is simple to mount and to remove, since it must always be removed when first section 20 of feeder 4 is to be replaced. It has an access window in the area of packings 32 SO that complete safety is ensured for operating personnel if the state of packings 32, and therefore the degree of wear and tear, has to be checked, which are sometimes in the immediate vicinity of rotating, high-pressure parts.

In the context of the present invention, repeated reference has been made to the use of seals. It is quite obvious that a drilling apparatus transporting water having a pressure in excess of 100 bars from the water supply to a tool must be made liquid tight. Seals must therefore be provided in all places that cannot be made liquid-tight in any other way, regardless of whether or not this has been mentioned in the above description.

What is claimed is:

1. A drive apparatus for a drill stem, in particular for decoking systems, having a feeder (4) connected to a water supply (8) via a first interface (6) and to a drill stem (12) via a second interface (10), and having a drive (14) and a gearbox (16) for rotatably driving said feeder (4) and said drill stem (12), characterized in that said feeder (4) has a first water carrying section (20) releasably connected to said water supply (8) and a second water carrying section (40) connected to said drill stem (12) and said first (20) and second (40) sections are releasably connected to each other at a point above the gearbox, said first section (20) of said feeder (4) forming an assembly together with sealing elements (32) and said first interface (6), and said assembly being formed as a unit being removable from the feeder in a direction transverse to a central axis of the feeder (4) upon releasing the connection of the first water carrying section (20) to said water supply (8) and the connection of said first (20) and second (40) sections.

2. The drive apparatus according to claim 1, characterized in that said first (20) and second (40) sections of said feeder (4) are clamped to each other.

3. The drive apparatus according to claim 2, characterized in that means (36) for clamping said first (20) and second (40) sections of said feeder (4) are provided.

4. The drive apparatus according to claim 1, characterized in that said first (20) and second (40) sections of said feeder (4) are bolted to each other.

5. The drive apparatus according to claim 1, characterized in that means are provided for bolting together said first (20) and second (40) sections of said feeder (4).

6. The drive apparatus according to claim 1, characterized in that said drive (14) of said feeder (4) and said drill stem (12) as well as the associated gearbox (16) are composed of well-known standardized parts.

7. The drive apparatus of claim 1, wherein the feeder defines a water flow passage from said water supply (8) to said drill stem (12), and wherein said first water carrying section (20) defines an upper portion of said water flow passage and wherein said second water carrying section (40) defines a lower portion of said water flow passage.

8. The drive apparatus of claim 1, wherein said first water carrying portion has a lower end and wherein said second water carrying portion has an upper end, and wherein the upper end of the second water carrying portion abuts the lower end of the first water carrying portion.

* * * * *